US007400853B2

(12) United States Patent
Furukawa

(10) Patent No.: US 7,400,853 B2
(45) Date of Patent: Jul. 15, 2008

(54) TRANSFER DEVICE AND IMAGE FORMING APPARATUS

(75) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 290 days.

(21) Appl. No.: 11/316,808

(22) Filed: Dec. 27, 2005

(65) Prior Publication Data

US 2006/0140687 A1 Jun. 29, 2006

(30) Foreign Application Priority Data

Dec. 28, 2004 (JP) ..... 2004-381915

(51) Int. Cl.
*G03G 15/16* (2006.01)

(52) U.S. Cl. ..... 399/313; 399/318

(58) Field of Classification Search ..... 399/313, 399/318, 297

See application file for complete search history.

(56) References Cited

U.S. PATENT DOCUMENTS 5,715,506 A * 2/1998 Takeuchi et al. ..... 399/313
6,173,137 B1 * 1/2001 Zona ..... 399/318
6,374,073 B2 * 4/2002 Ozaki et al. ..... 399/313
6,449,444 B1 * 9/2002 Tanaka ..... 399/313
6,549,745 B2 * 4/2003 May et al. ..... 399/313
6,556,798 B2 * 4/2003 Rimai et al. ..... 399/297
6,795,669 B2 * 9/2004 Yamauchi et al. ..... 399/313
7,215,914 B2 * 5/2007 Murakami et al. ..... 399/313
2004/0228659 A1 * 11/2004 Nishida ..... 399/313
2005/0117938 A1 * 6/2005 Iino et al. ..... 399/313

FOREIGN PATENT DOCUMENTS

JP 2228683 9/1990
JP 4215680 8/1992
JP 08211759 A * 8/1996
JP 9106220 4/1997
JP 09305040 A * 11/1997
JP 10198197 7/1998
JP 2000321892 11/2000
JP 2003156947 5/2003

* cited by examiner

*Primary Examiner*—Susan S Lee
(74) *Attorney, Agent, or Firm*—Banner & Witcoff, Ltd

(57) ABSTRACT

A transfer device includes a transfer roller that is rotatably provided facing an image carrying member, an urging device that urges the transfer roller in a direction that the transfer roller presses the image carrying member, and a regulating roller that is provided to a shaft commonly used with the transfer roller and presses the image carrying member to regulate a pressing force of the transfer roller that presses the image carrying member. The regulating roller is made of an elastic material.

15 Claims, 7 Drawing Sheets

(a)

TRANSFER DEVICE AND IMAGE FORMING APPARATUS

CROSS REFERENCE TO RELATED APPLICATION

This application claims priority from Japanese Patent Application No. 2004-381915, filed on Dec. 28, 2004, the subject matter of which is incorporated herein in its entirety by reference thereto.

TECHNICAL FIELD

Aspects of the invention relate to a transfer device that transfers a developing agent image, which is formed on an image carrying member, onto a recording medium, and an image forming apparatus including the transfer device.

BACKGROUND

Image forming apparatuses, such as laser printers, form a toner image onto a recording medium by transferring the toner image from a photosensitive drum. In such image forming apparatuses, an electrostatic latent image formed on a photosensitive drum is developed by using toner (a developing agent) to form a toner image on a surface of the photosensitive drum. Then, by using a transfer roller to which a transfer bias is applied and that rotates with pressing the photosensitive drum, the toner image is electrically transferred to a recording medium from the photosensitive drum while the recording medium is pinched at a pressing portion (a nip portion) between the photosensitive drum and the transfer roller.

For example, as shown in FIG. 6, such a transfer roller commonly includes a roller portion 211 that presses a photosensitive drum 201 and a rotating shaft 212 that protrude from both ends of the roller portion 211 in an axial direction of the transfer roller.

In order to press the roller portion 211 of the transfer roller against the photosensitive drum 201, an urging device (e.g. a compression spring) that urges the rotating shaft 212 toward the photosensitive drum 201 is provided. In a transfer device of FIG. 6, however, the rotating shaft 212 of the transfer roller is urged at its both end portions, so that the rotating shaft 212 and the roller portion 211 are warped such that middle portions thereof move away from the photosensitive drum 201 as the both end portions thereof move closer to the photosensitive drum 201 (in the drawing, the warp of the rotating shaft 212 is exaggerated for the sake of clarity). As a result, a pressing force of the transfer roller that acts on the photosensitive drum 201 may vary between the end portions and the middle portion of the roller portion 211 of the transfer roller. If the pressing force of the transfer roller varies as described above, a nip width between the transfer roller and the photosensitive drum 201 may become non-uniform, resulting in a transfer current varying by portion. If the transfer current is not maintained within a substantially constant range, image quality may be degraded.

In order to resolve the above problem, for example, Japanese Laid-Open Patent Publication No. 10-198197 discloses a structure such that cylindrical rollers are provided to a rotating shaft of a transfer roller in order to regulate a pressing force of a roller portion of the transfer roller that acts on a photosensitive drum.

However, the rollers are generally made of a material having high stiffness, so that the pressing force of the roller portion of the transfer roller that acts on the photosensitive drum (hereinafter, referred to as a roller pressing force) significantly varies if variations occur in a diameter of the rollers. More specifically, when the rollers have a larger diameter than an optimum diameter, the roller pressing force becomes weak as compared with the roller pressing force when the rollers have the optimum diameter. When the rollers have a smaller diameter than the optimum diameter, the roller pressing force becomes strong. That is, in order to maintain an optimum roller pressing force, the rollers need to be manufactured with very high precision. If there is a dimension error (e.g., difference in a diameter, or deviation of the center) between the right and left rollers, the nip width between the transfer roller and the photosensitive drum considerably varies at the right and left portions. Therefore, a transfer current becomes non-uniform and thus a defect may occur in an image transfer. In addition, because the rollers are made of a material having high stiffness, the rollers may cause damage to a member with which the rollers make contact (e.g., a photosensitive drum, an intermediate transfer belt, or a sheet transfer belt).

This effect may also be seen or further compounded if there is play in a driving system that also supports the rotating shaft of the transfer roller.

SUMMARY

Aspects of the invention moderate a dimension precision of regulating rollers and prevent or minimize damage to a member with which the regulating rollers make contact and a warp of a transfer roller.

According to one aspect of the invention, a transfer device may include a transfer roller that is rotatably provided facing an image carrying member, an urging device that urges the transfer roller in a direction that the transfer roller presses the image carrying member, and a regulating roller that is provided to a shaft commonly used with the transfer roller and presses the image carrying member to regulate a pressing force of the transfer roller that presses the image carrying member. The regulating roller can have an elastic effect. In some instances, the regulating rollers may be may be made of materials that are intrinsically elastic including but not limited to an elastic material, two or more materials of which at least one is elastic compared to the other, or materials that have varying elasticity. In other instances, the regulating rollers may be made of materials that are not always intrinsically elastic but function as elastic materials through the use of physical or structural arrangements, resulting in the regulating rollers having an elastic characteristic.

According to another aspect of the invention, an image forming apparatus may include an image carrying member, a developing device that supplies a developing agent to the image carrying member, a transfer roller that is rotatably provided facing the image carrying member, an urging device that urges the transfer roller in a direction that the transfer roller presses the image carrying member, and a regulating roller that is provided to a shaft commonly used with the transfer roller and presses the image carrying member to regulate a pressing force of the transfer roller that presses the image carrying member. The regulating roller may be made of an elastic material or other materials (possibly including structural arrangements) that provide an elastic characteristic for the regulating roller.

BRIEF DESCRIPTION OF THE DRAWINGS

Illustrative aspects of the invention will be described in detail with reference to the following figures wherein.

DETAILED DESCRIPTION

It is noted that various connections are set forth between elements in the following description. It is noted that these connections in general and, unless specified otherwise, may be direct or indirect and that this specification is not intended to be limiting in this respect.

Figure 1:
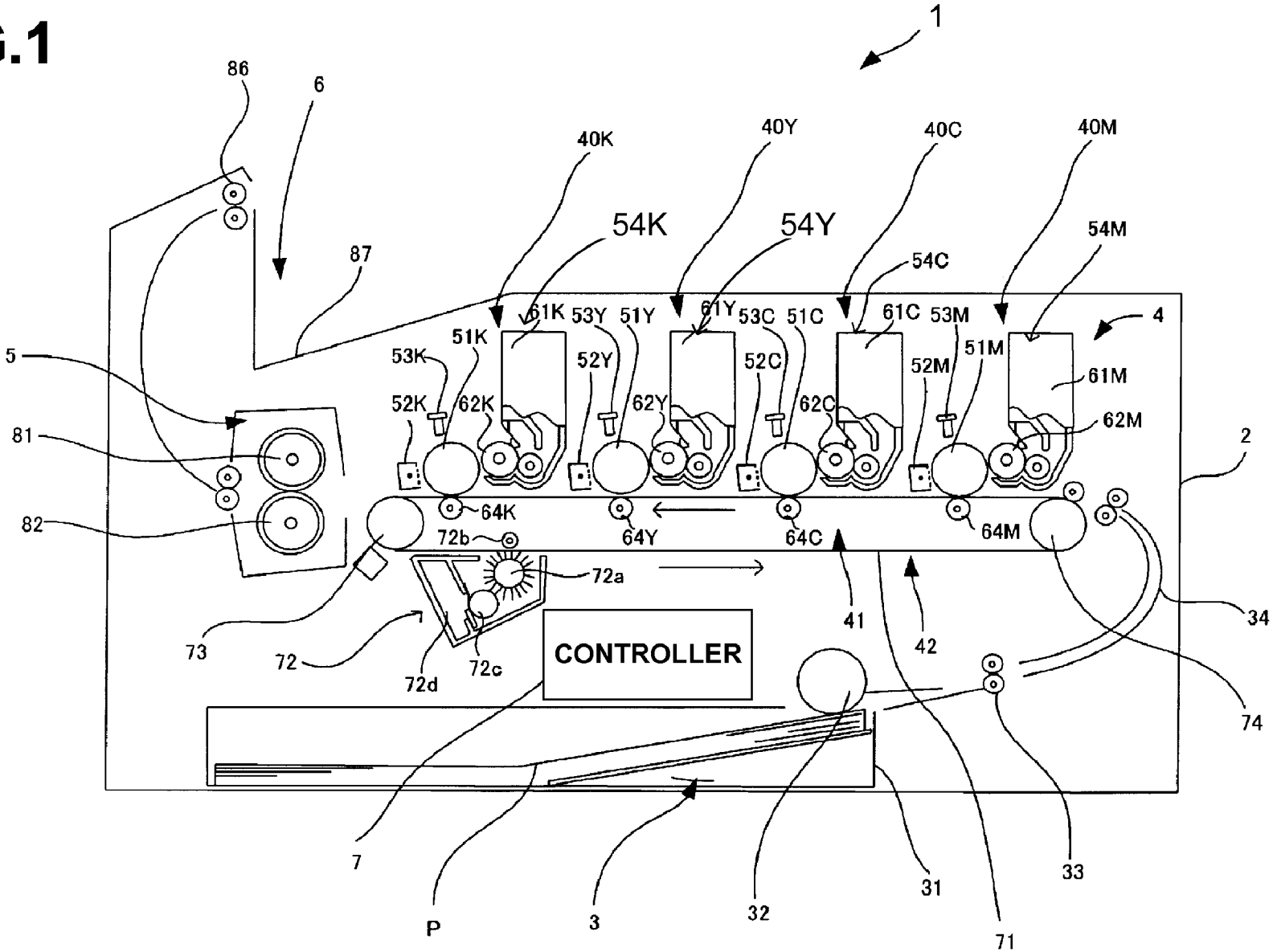
FIG. 1 is a side sectional view showing a schematic structure of a color laser printer according to an illustrative embodiment of the invention.

As shown in FIG. 1, a color laser printer 1 of an illustrative embodiment includes a horizontally-elongated housing 2, a sheet feeding portion 3, an image forming portion 4, a fixing portion 5, a sheet discharge portion 6 and a controller 7. The housing 2 accommodates therein various devices and units constituting the laser printer 1. The sheet feeding portion 3 feeds a recording sheet P therefrom. The image forming portion 4 forms an image onto the recording sheet P fed from the sheet feeding portion 3. The fixing portion 5 fixes the image, which has been formed on the recording sheet P at the image forming portion 4, onto the recording sheet P. The sheet discharge portion 6 discharges the recording sheet P, on which the image has been fixed at the fixing portion 5, from the housing 2. The controller 7 controls the operation of the laser printer 1.

The sheet feeding portion 3 includes, at a bottom in the housing 2, a sheet supply tray 31, a sheet supply roller 32, a pair of conveyor rollers 33, and a guide member 34. The sheet supply tray 31 is capable of being attached and detached with respect to the housing 2 and is capable of accommodating therein a plurality of recording sheets P in layers. The sheet supply roller 32 is disposed above the sheet supply tray 31, and separates and sends the recording sheets P, one by one, from the stack accommodated in the sheet supply tray 31. The pair of conveyor rollers 33 is disposed downstream from the sheet supply roller 32 in a conveying direction of the recording sheet P and conveys the recording sheet P supplied by the sheet supply roller 32. The guide member 34 guides the recording sheet P to the image forming portion 4 while the recording sheet P is being conveyed by the conveyor rollers 33.

The image forming portion 4 includes a magenta image forming unit 40M, a cyan image forming unit 40C, an yellow image forming unit 40Y, and a black image forming unit 40K, each of which forms an image corresponding to each respective color of magenta (M), cyan (C), yellow (Y), and black (K). The image forming portion 4 further includes a transfer portion 41 and a conveyor portion 42. The transfer portion 41 transfers images, which have been formed by the respective image forming units 40M, 40C, 40Y, 40K, onto a recording sheet P. The conveyor portion 42 conveys a recording sheet P to each image transfer position (TP).

The image forming units 40M, 40C, 40Y, 40K are aligned in this order, in a horizontal direction, from upstream to downstream, with respect to the conveying direction of the recording sheet P. In other words, the laser printer 1 is a tandem-type color laser printer.

The magenta image forming unit 40M includes a photosensitive drum 51M, a charging device 52M, an exposing device 53M, and a developing unit 54M. The photosensitive drum 51M carries an electrostatic latent image thereon. The charging device 52M is disposed in a vicinity of the photosensitive drum 51M and charges the photosensitive drum 51M. The exposing device 53M forms an electrostatic latent image onto the photosensitive drum 51M. The developing unit 54M forms a development agent image on the photosensitive drum 51M by adhering a developing agent to the photosensitive drum 51M.

The photosensitive drum 51M includes a substantially cylindrical member and is rotatably provided in the magenta image forming unit 40M. The substantially cylindrical member of the photosensitive drum 51M includes an aluminum base member coated with a positively-charged photosensitive layer. The aluminum base member is connected to a ground line of the laser printer 1.

Figure 2:
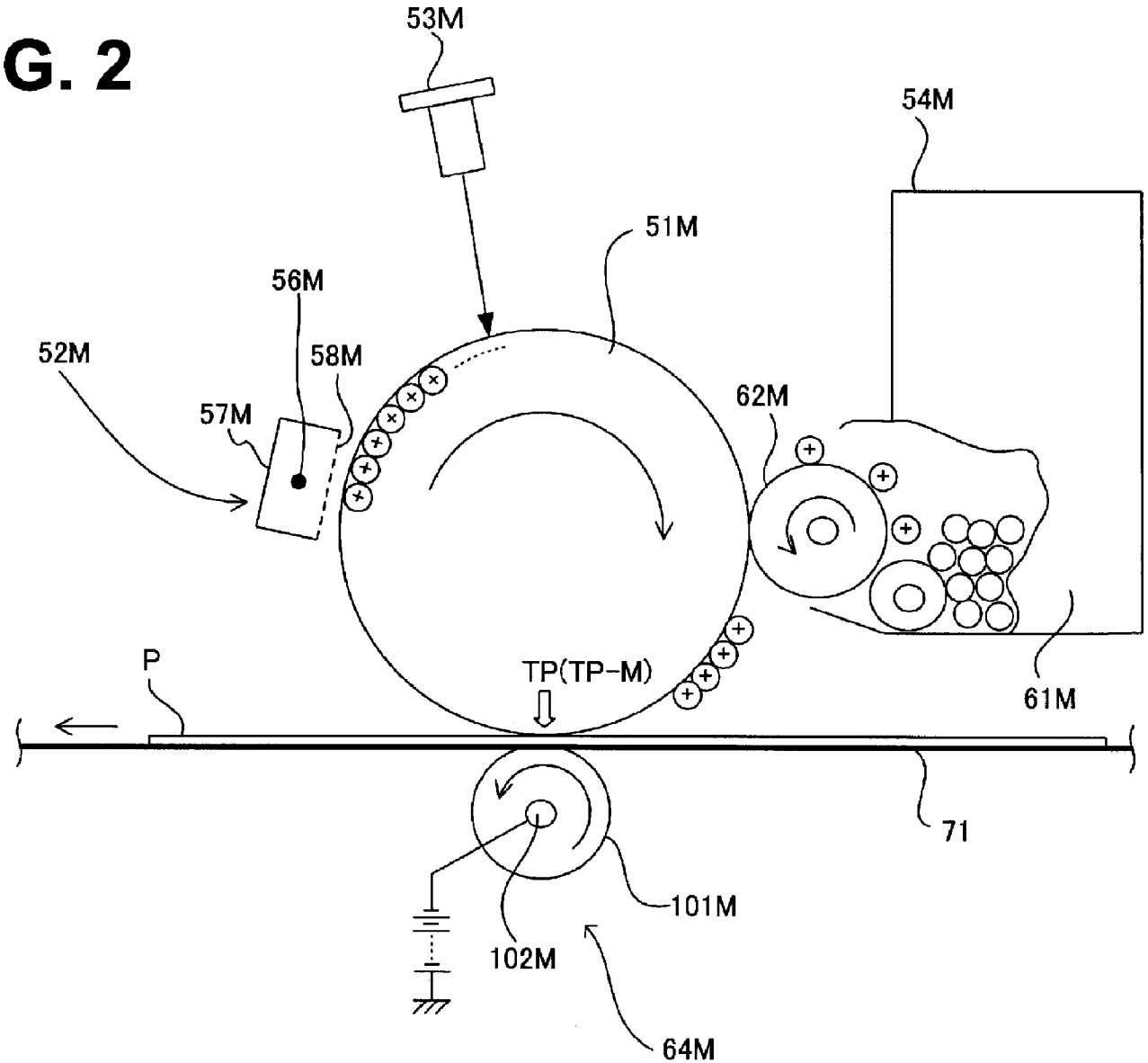
FIG. 2 is a schematic diagram showing a structure in a vicinity of a transfer nip portion according to an illustrative embodiment of the invention.

The charging device 52M is a so-called scorotron charger. As shown in FIG. 2, the charging device 52M includes a charging wire 56M, a shield case 57M, and a grid 58M. The charging wire 56M extends along a length of the photosensitive drum 51M while facing the photosensitive drum 51M. The shield case 57M accommodates the charging wire 56M therein and has an open side toward the photosensitive drum 51M. The grid 58M is provided in the open portion of the shield case 57M.

A high voltage is applied to the charging wire 56M and a constant voltage (for example, +700 V), which is lower than the voltage applied to the charging wire 56M, is applied to the grid 58M. Thus, a surface of the photosensitive drum 51M is made to be at the substantially same potential as a voltage of the grid 58M.

The exposing device 53M is disposed downstream from the charging device 52M with respect to a rotating direction of the photosensitive drum 51M (in a clockwise direction in FIG. 2). The exposing device 53M emits laser light, which corresponds to a single color (e.g. magenta) of image data inputted from the controller 7, from a light source, scans the laser light by a mirror surface of a polygon mirror driven by a polygon motor (not shown), and irradiates the surface of the photosensitive drum 51M with the laser light.

The laser light emitted from the exposing device 53M is irradiated onto the surface of the photosensitive drum 51M, so that the surface potential of the exposed portion of the photosensitive drum 51M becomes lowered to, for example, +150 V, and an electrostatic latent image is thus formed on the surface of the photosensitive drum 51M.

In FIGS. 1 and 2, the exposing device 53M is shown with only the portion which emits laser light while most parts or portions thereof are omitted from the drawings.

As shown in FIG. 2, the developing unit 54M includes a developing unit case 61M and a developing roller 62M. The developing unit case 61M reserves magenta toner therein. The developing roller 62M supplies the magenta toner onto the charged surface of the photosensitive drum 51M. The magenta toner reserved in the developing unit case 61M is a positively charged nonmagnetic single-component developing agent.

The developing roller 62M includes a cylindrical base member made of, for example, a conductive silicone rubber. A surface of the developing roller 62M is coated with a coating layer made of, for example, a resin containing fluorine or a rubber material. The developing roller 62M is disposed downstream from the exposing device 53M with respect to the rotating direction of the photosensitive drum 51M while being in contact with the photosensitive drum 51M. A developing bias (for example, +550 V) is applied to the developing roller 62M.

The developing unit 54M positively charges the reserved toner and then supplies the positively-charged toner to the developing roller 62M as a uniform thin layer. In addition, at a contact portion of the developing roller 62M and the photosensitive drum 51M, the positively-charged toner is applied to the positive electrostatic latent image formed on the photosensitive drum 51M, in order to develop the electrostatic latent image by a reverse development method. By doing so, a toner image is formed on the photosensitive drum 51M.

A cleanerless method is adopted in the developing unit 54M. In this cleanerless method, toner remaining on the surface of the photosensitive drum 51M after a toner image is transferred onto a recording sheet P by the transfer device 64M, is collected by the developing roller 62M.

As shown in FIG. 1, the image forming unit 40C includes a photosensitive drum 51C, a charging device 52C, an exposing device 53C and a developing unit 54C. The image forming unit 40Y includes a photosensitive drum 51Y, a charging device 52Y, an exposing device 53Y and a developing unit 54Y. The image forming unit 40K includes a photosensitive drum 51K, a charging device 52K, an exposing device 53K and a developing unit 54K.

In other words, the image forming units 40C, 40Y, 40K have the same structure as the magenta image forming unit 40M, except their developing units 54C, 54Y, 54K reserve cyan toner, yellow toner, and black toner, respectively.

The conveyor portion 42 includes a sheet conveyor belt 71 and a developing agent collector 72. The sheet conveyor belt 71 horizontally conveys a recording sheet P fed from the sheet feeding portion 3. The developing agent collector 72 is disposed downstream from the black image forming unit 40K in the sheet conveying direction and collects toner adhering to a surface of the sheet conveyor belt 71.

The sheet conveyor belt 71 has a width that is narrower than the length of the photosensitive drums 51M, 51C, 51Y, 51K. The sheet conveyor belt 71 is an endless belt that runs between a drive roller 73 and a following roller 74 and rotates while holding a recording sheet P on its upper surface.

With this structure, by the rotation of the drive roller 73, a surface of the sheet conveyor belt 71 facing the photosensitive drums 51M, 51C, 51Y, 51K, moves in a direction from right to left in FIG. 1 (as indicated by arrows). That is, the sheet conveyor belt 71 conveys a recording sheet P fed from the sheet feeding portion 3 to portions between each of the photosensitive drums 51M, 51C, 51Y, 51K and the surface of the sheet conveyor belt 71 and further conveys the recording sheet P to the fixing portion 5.

The developing agent collector 72 includes a cleaning brush 72*a*, an electrode roller 72*b*, a collecting roller 72*c*, and a storage box 72*d*. The cleaning brush 72*a* collects the toner adhering to the surface of the sheet conveyor belt 72 therefrom. The electrode roller 72*b* is disposed opposite to the cleaning brush 72*a* while the sheet conveyor belt 71 is sandwiched therebetween. The collecting roller 72*c* removes the toner adhering to the cleaning brush 72*a* therefrom. The storage box 72*d* stores therein the toner removed from the cleaning brush 72*a* by the collecting roller 72*c*.

The cleaning brush 72*a* includes a substantially cylindrical member and a brush portion provided around the cylindrical member. The cylindrical member extends along the width of the sheet conveyor belt 71. The cleaning brush 72*a* rotates while being in contact with the sheet conveyor belt 71 and a bias voltage for generating a predetermined potential between the electrode roller 72*b* and the cleaning brush 72 is applied to the cleaning brush 72*a*.

Thus, an electric field is generated between the cleaning brush 72*a* and the electrode roller 72*b*, so that the toner adhering to the surface of the sheet conveyor belt 71 moves toward the cleaning brush 72*a* and is thus collected by the cleaning brush 72*a*.

The transfer portion 41 includes transfer devices 64M, 64C, 64Y, 64K. The transfer devices 64M, 64C, 64Y, 64K are disposed facing the corresponding photosensitive drums 51M, 51C, 51Y, 51K, on a side where the developing units 54M, 54C, 54Y, 54K are not provided, while the sheet conveyor belt 71 is sandwiched therebetween.

Figure 3:
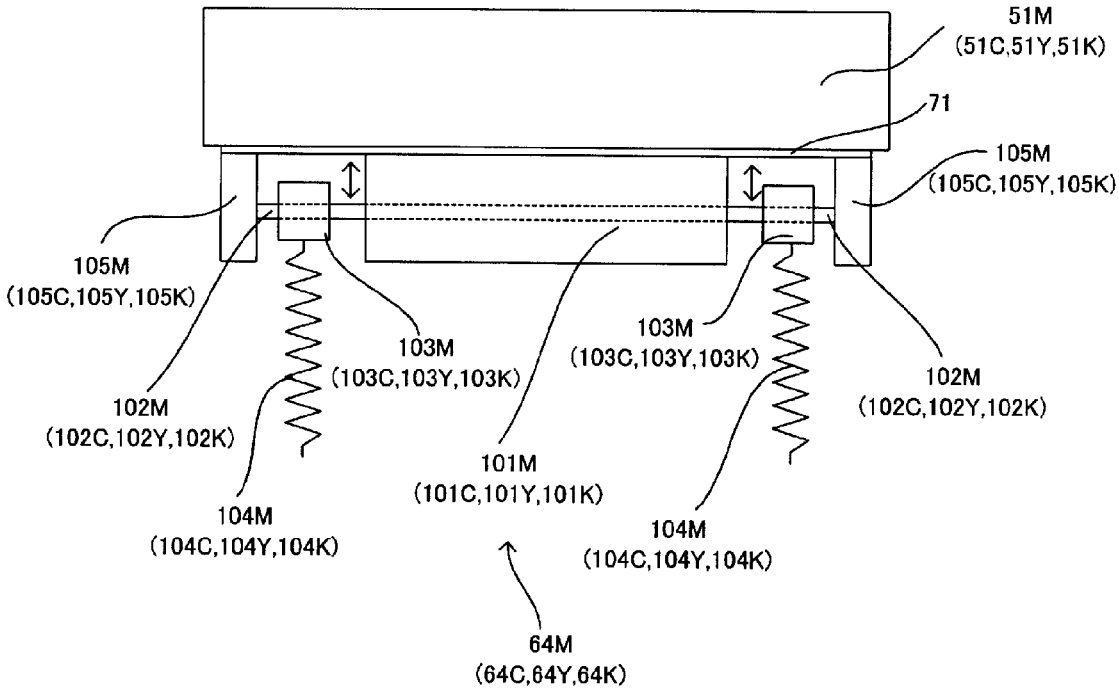
FIG. 3 is a front view of a photosensitive drum and a transfer device according to an illustrative embodiment of the invention.

As shown in FIG. 3, the transfer device 64M includes a cylindrical transfer roller 101M, a rotating shaft 102M, bearings 103M, urging springs 104M, and cylindrical rollers 105M (functioning as a regulating roller). The transfer roller 101M is made of an elastic member, such as a rubber material having ionic conductivity. The rotating shaft 102M is provided so as to protrude from both ends of the transfer roller 101M in directions away from the transfer roller 101M with respect to an axial direction of the transfer roller 101M. The bearings 103M support the rotating shaft 102M at the sides of the transfer roller 101M in the axial direction of the transfer roller 101M so that the rotating shaft 102M is rotatable. The urging springs 104M are disposed at the sides of the transfer roller 101M in the axial direction of the transfer roller 101M in order to urge the rotating shaft 102M in a direction that the transfer roller 101M presses the photosensitive drum 51M (hereinafter, referred to as a roller pressing direction). The rollers 105M are provided to the rotating shaft 102M so as to be opposite to the respective ends of the transfer roller 101M while each of the bearings 103M is sandwiched therebetween.

The bearings 103M are guided by a guide member (not shown) so as to be slidable in the roller pressing direction. One ends of the urging springs 104M are connected to the respective bearings 103M. That is, the rotating shaft 102M of the transfer roller 101M is urged by the urging springs 104M via the bearings 103M. Although coil compression springs are used as the urging springs 104M in this illustrative embodiment, tension springs or leaf springs can be used instead.

Just like the transfer device 64M, as shown in FIG. 3, the transfer device 64C includes a cylindrical transfer roller 101C, a rotating shaft 102C, bearings 103C, urging springs 104C and cylindrical rollers 105C. The transfer device 64Y includes a cylindrical transfer roller 101Y, a rotating shaft 102Y, bearings 103Y, urging springs 104Y, and cylindrical rollers 105Y. The transfer device 64K includes a cylindrical transfer roller 101K, a rotating shaft 102K, bearings 103K, urging springs 104K and cylindrical rollers 105K.

A material used for the rollers 105 (105M, 105C, 105Y, 105K) is an elastic material having a hardness that is higher than the material used for the portion of the transfer roller 101 (101M, 101C, 101Y, 101K) that presses the photosensitive drum 51 (51M, 51C, 51Y, 51K). In addition, the rollers 105 have a diameter that is larger than that of the transfer roller 101. Alternatively, rollers 105 may include a different material or materials that intrinsically either alone or in combination exhibit an elastic urging of rollers 105 against the sheet conveyer belt 71. Illustrative examples of rollers 105 are shown in FIGS. 7A-7F below.

A negative-polarity voltage, which has a polarity opposite to a polarity that the charging device 52M charges the photosensitive drum 51M (a positive-polarity), is applied to the transfer roller 101M via the rotating shaft 102M by a so-called constant current control (for example, −10 to 15 μA). Thus, an appropriate transfer bias is applied to a portion between the transfer roller 101M and the photosensitive drum 51M in the transfer device 64M. In the transfer devices 64C, 64Y, 64K, the same operation is performed as that performed in the transfer device 64M.

As shown in FIG. 1, the fixing portion 5 includes a heat roller 81 (functioning as a heat body) and a pressure roller 82. The pressure roller 82 is disposed so as to be opposite to and be press-contacted to the heat roller 81 while a conveying path of the recording sheet P is sandwiched therebetween. With this structure, at the fixing portion 5, a multicolor image including toner images of four colors is fixed onto a recording sheet P by which heat and pressure are applied to the recording sheet P having the multicolor image while the recording sheet P is being pinched and conveyed by the heat roller 81 and the pressure roller 82.

The sheet discharge portion 6 includes a pair of discharge rollers 86 and an output tray 87. The pair of discharge rollers 86 conveys the recording sheet P on which the multicolor image has been fixed at the fixing portion 5. The output tray 87 is disposed downstream from the discharge rollers 86 in the sheet conveying direction in order to hold the recording sheets P that underwent the image forming process.

In the laser printer 1 of the illustrative embodiment, first, a single recording sheet P is supplied from the sheet feeding portion 3 by the sheet supply roller 32 and is further conveyed to the sheet conveyor belt 71 via the pair of conveyor rollers 33 and the guide member 34.

Next, the surface of the rightmost photosensitive drum 51M (a first color) in FIG. 1 is uniformly charged at +700 V by the charging device 52M, and then, is exposed to laser light based on data corresponding to magenta of image data inputted from the controller 7. Thus, the potential of the exposed portion at the surface of the photosensitive drum 51M becomes lowered to approximately +150 V and an electrostatic latent image is formed on the surface of the photosensitive drum 51M. After that, the positively-charged magenta toner is supplied to the surface of the photosensitive drum 51M by the developing roller 62M to which a developing bias (+550 V) is applied in the developing unit 54M. As a result, the magenta toner adheres to the portion of the photosensitive drum 51M whose potential is lower than that of the developing bias due to the formation of the electrostatic latent image, and thus, development is performed to form a magenta toner image on the surface of the photosensitive drum 51M. The positively-charged toner image formed as described above is then transferred onto a surface of a recording sheet P placed on the upper surface of the sheet conveyor belt 71. As described above, the transfer of the toner image is electrostatically performed by the transfer device 64M to which the negative transfer bias is applied.

After that, the recording sheet P onto which the magenta toner image has been transferred is further conveyed by the sheet conveyor belt 71, and contacts the photosensitive drum 51C for cyan toner (a second color). Then, as is the case with the transfer of the magenta toner image, a cyan toner image is transferred onto the recording sheet P having the magenta toner image. That is, the cyan toner image is electrostatically transferred onto the recording sheet P from the photosensitive drum 51C having the cyan toner image thereon by the transfer bias which is applied by the transfer device 64C located opposite to the photosensitive drum 51C.

After that, as is the case with the transfer of the magenta and cyan toner images, a yellow toner image (a third color) and a black toner image (a fourth color) are successively transferred onto the recording sheet P having the magenta and cyan toner images. Then, a multicolor image having the four-color toner images formed on the recording sheet P is finally fixed onto the recording sheet P at the fixing portion 5 and is discharged onto the output tray 87.

The rollers 105 of the illustrative embodiment can be made of the elastic material, so that the portions of the rollers 105 that press the photosensitive drum 51 (hereinafter, referred to as roller pressing portions) are shrinkingly deformed when the rollers 105 press the photosensitive drum 51. Further, the rollers 105 may include one or more components that alone or combination provide an elastic effect for rollers 105. The effect may be provided intrinsically by the material or materials and/or by their structure. Thus, even if the rollers 105 have different diameters due to manufacturing error, the force can equally act on the rollers 105 and the transfer roller 101. Accordingly, the dimension accuracy of the rollers 105 can be moderated.

In addition, the rollers 105 are elastically deformed in accordance with an outer shape of a member with which the rollers 105 make contact. That is, the pressing force of the rollers 105 that press the photosensitive drum 51 does not concentrate on one point at the member. Therefore, as compared with a transfer device equipped with regulating rollers made of a material having high stiffness, in the transfer device 64 (64M, 64C, 64Y, 64K) of the illustrative embodiment, the member with which the rollers 105 make contact (i.e. the sheet conveyor belt 71 in this illustrative embodiment) can be prevented from being damaged by the rollers 105.

The material used for the rollers 105 can be an insulation material, so that the transfer current applied to the transfer device 64 can be prevented from being fed to the photosensitive drum 51 via the rollers 105. That is, the transfer current can be surely controlled. Alternatively, the material or materials used for rollers 105 can include semi-conducting and conducting materials as well.

The rollers 105 are provided to the rotating shaft 102 (102M, 102C, 102Y, 102K) so as to be opposite to the respective ends of the transfer roller 101 while each of the bearings 103 (103M, 103C, 103Y, 103K) is sandwiched therebetween at each side of the transfer roller 101. With this structure, when the rollers 105 press the photosensitive drum 51 by which the bearings 103 are urged by the urging springs 104 (104M, 104C, 104Y, 104K), a repulsive force (hereinafter, referred to as a roller pressure repulsive force) is generated therebetween by the pressing and is applied to the portions of the rotating shaft 102 where the rollers 105 are provided. It is appreciated that springs 104 may also include other biasing materials that alone or in combination provide a biasing force to rotating shaft 102. For simplicity, the term "spring" is used herein but is intended to include other biasing members including rubber, metal, plastic, and ceramics that alone or in combination provide a biasing force.

In other words, in the transfer device 64, the force that is reverse to the direction that the urging springs 104 urge the rotating shaft 102 is applied to the portions that are far from the transfer roller 101 than the portions where the urging springs 104 urge the rotating shaft 102.

Accordingly, the rotating shaft 102 of the transfer roller 101 can be prevented from warping, due to the urging force of the urging springs 104, in a direction that the end portions of the rotating shaft 102 move closer to the photosensitive drum 51.

Figure 6:
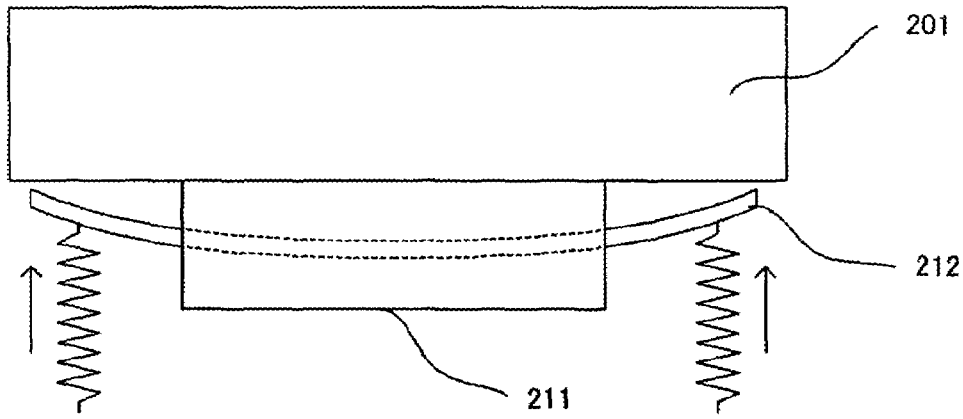
FIG. 6 RELATED ART
FIG. 6 is a front view of a photosensitive drum and a transfer device for explaining a warp of a transfer roller.

In case where regulating rollers are not provided to a rotating shaft of a transfer roller, if a force of urging springs is made weak in order to minimize a warp of the rotating shaft, the rotating shaft is susceptible to disturbances, such as friction and vibration (see FIG. 6). Therefore, it is not preferable that the force of the springs is made weak. In addition, if the rotating shaft becomes thick, the weight of the rotating shaft is increased although the warp in the rotating shaft can be minimized. Thus, in order to increase the force of the urging springs and minimize the warp of the rotating shaft, it is preferable that a member that acts on a photosensitive member is provided as near as possible to the urging springs. Then, regulating rollers may be provided at sides of a roller portion of the transfer roller to implement such a condition. By doing so, the warp of the rotating shaft can be minimized. In addition, if the regulating rollers are disposed outside the respective urging springs in an axial direction of the rotating shaft, the warp of the rotating shaft can be prevented by keeping the pressing force of the urging springs and the reverse force in balance. There may be a case where the performance of the image transfer is degraded due to a weak pressing force of the roller portion of the transfer roller against the photosensitive drum. If, however, the regulating rollers are provided outside the respective urging springs in an axial direction of the rotating shaft, the warp of the rotating shaft can be prevented even when the pressing force of the roller portion against the photosensitive drum is increased.

In the above-described illustrative embodiment, the laser printer 1 can function as an image forming apparatus, the urging springs 104 function as an urging device, the recording sheet P functions as a transferred medium and the rollers 105 function as a regulating roller.

While the invention has been described in detail with reference to the specific embodiment thereof, it would be apparent to those skilled in the art that various changes, arrangements and modifications may be applied therein without departing from the spirit and scope of the invention.

In the above-described illustrative embodiment, the description has been made, taking a direct-transfer-type tandem color laser printer as an example. In such a printer, a toner image of each color is directly transferred onto a recording sheet P from each of the photosensitive drums 51M, 51C, 51Y, 51K. However, the invention is not limited to the above-described illustrative embodiment, and may be applied to intermediate-transfer-type tandem color laser printers. In such printers, a toner image of each color is transferred onto an intermediate transfer belt once from each photosensitive drum and then all the toner images on the intermediate transfer belt are transferred onto a recording sheet at the same time.

Further, the invention is not limited to the tandem color laser printers. The invention may also be applied to, for example, four-cycle-type color laser printers. In such printers, a toner image of each color is successively formed on a single photosensitive member commonly provided for developing units for respective colors and each of the formed toner images is successively transferred onto a transferred member, such as a recording sheet, a transfer belt, or an intermediate transfer drum, so as to be overlapped with each other to form a multicolor toner image on the transferred medium.

The invention may be also applied to monochrome laser printers, but not limited to the color laser printers.

In the above-described illustrative embodiment, the transfer device 64 that regulates the force of the transfer roller 101 that presses the photosensitive drum 51 by employing the rollers 105, have been shown. However, other device may be used to regulate the pressing force of the transfer roller 101, instead of using the rollers 105.

Figure 4A:
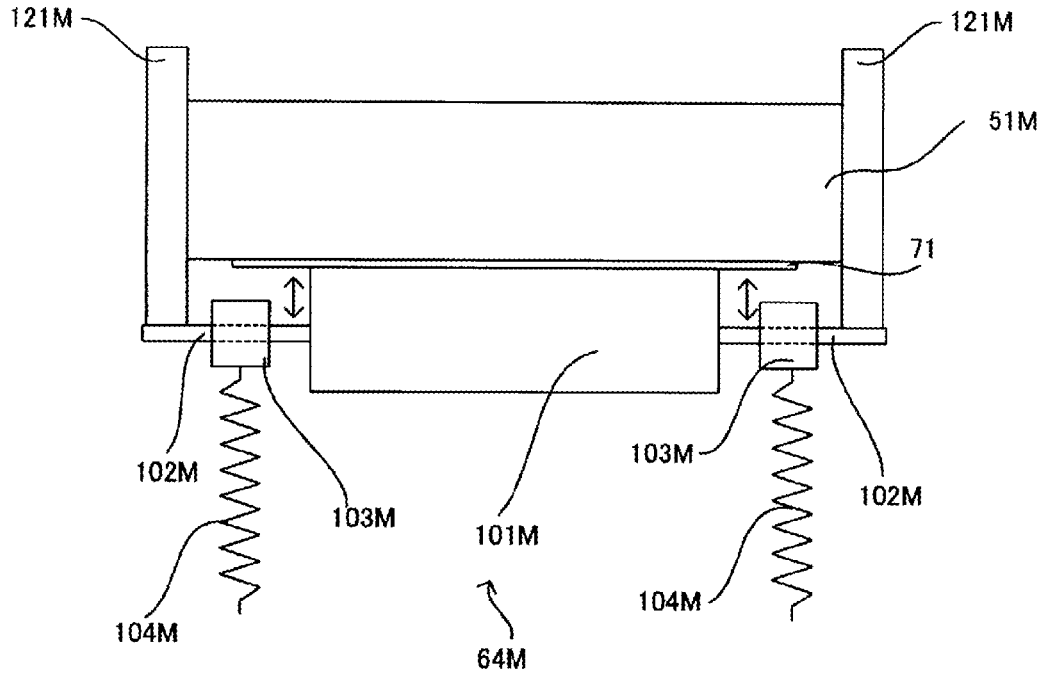
FIG. 4 is a front view of a photosensitive drum and a transfer device according to another illustrative embodiment of the invention.

For example, as shown in FIG. 4A, cylindrical regulating members 121M can be provided at the both ends of the photosensitive drum 51M. The regulating members 121M outwardly protrude from an entire circumference of the photosensitive drum 51M at the both ends so as to extend across a circumference direction of the photosensitive drum 51M. A material used for the regulating members 121M is an elastic material, such as a rubber material. A diameter of the regulating members 121M is determined such that the circumferences of the regulating members 121M make contact with the rotating shaft 102M. The regulating members 121M function as a pressing device.

Figure 4B:
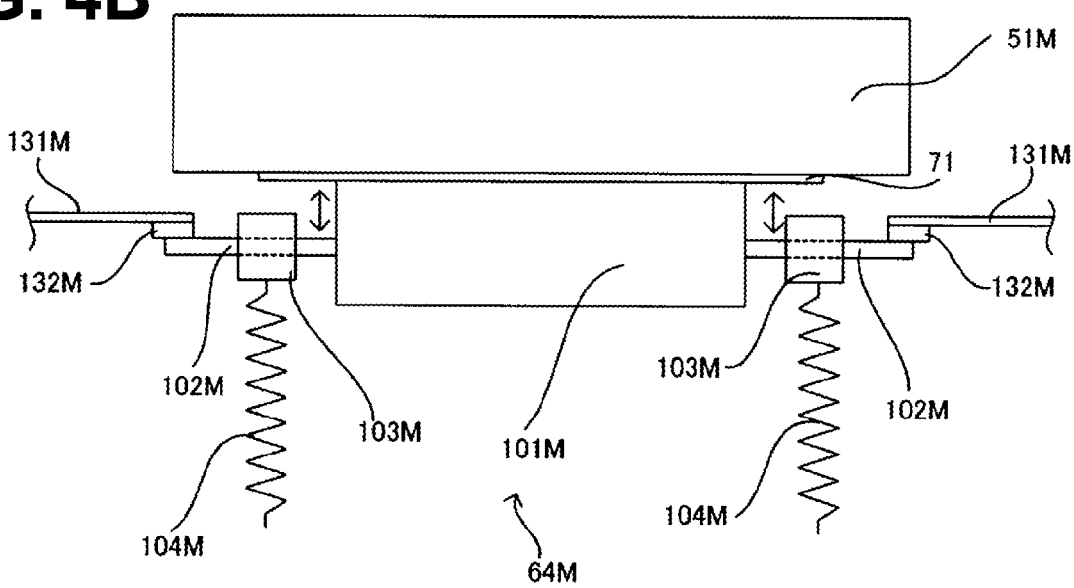

Alternatively, as shown in FIG. 4B, regulating members 132M that are supported by support members 131M fixed to the main body of the laser printer 1 and that contact the rotating shaft 102M, may be provided. A material used for the regulating members 132M can be an elastic material, such as a rubber material, or other material or materials that alone or in combination exhibit an elastic effect. The regulating members 132M function as a pressing device.

Figure 4C:
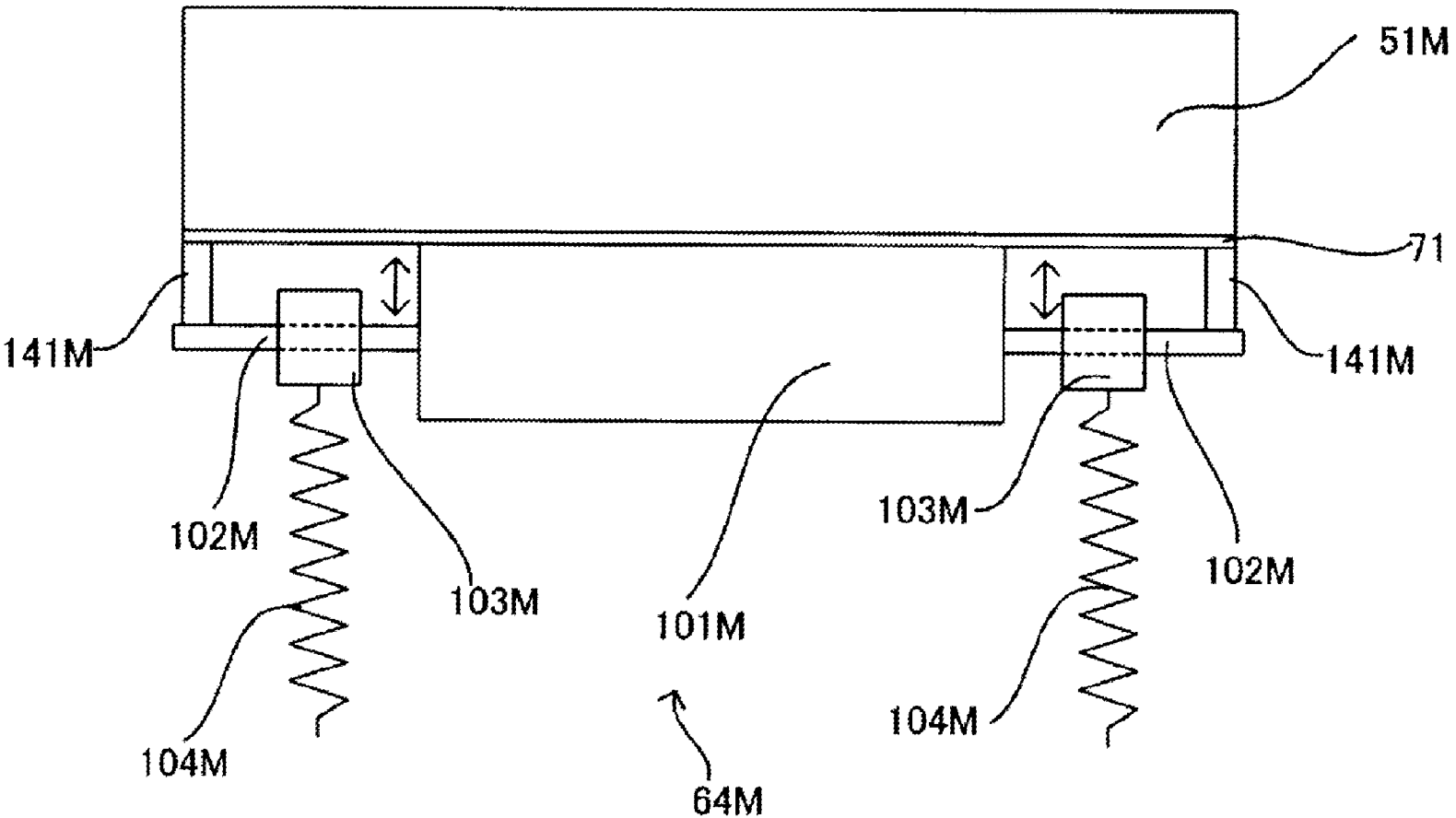

Alternatively, as shown in FIG. 4C, regulating members 141M may be provided at both ends of the sheet conveyor belt 71. The regulating members 141M extend along the sheet conveying direction and across the entire circumference of the undersurface of the sheet conveyor belt 71 and protrude from the surface of the sheet conveyor belt 71 opposite to the transfer roller 101M.

A material used for the regulating members 141M can be an elastic material, such as a rubber material, or other material or materials that alone or in combination exhibit an elastic effect. The height of the regulating members 141M are determined such that the regulating members 141M make contact with the rotating shaft 102M. The regulating members 141M function as a pressing device.

In the laser printer 1 having a transfer device 64M structured as shown in FIG. 4A, 4B, or 4C, the pressing force that a transfer roller presses an image carrying member is regulated by the regulating members 121M, 132M, or 141M. Accordingly, the rollers 105 are not necessary to be provided, so that the member with which the rollers 105 make contact can be prevented from being damaged.

If the rollers 105 and the regulating members 121M, 132M, 141M have sufficient dimension accuracy, they can prevent at least the warp of the rotating shaft 102. Accordingly, the material used for the rollers 105 and the regulating members 121M, 132M, 141M is not limited to an elastic material, but other material can be used.

Figure 5:
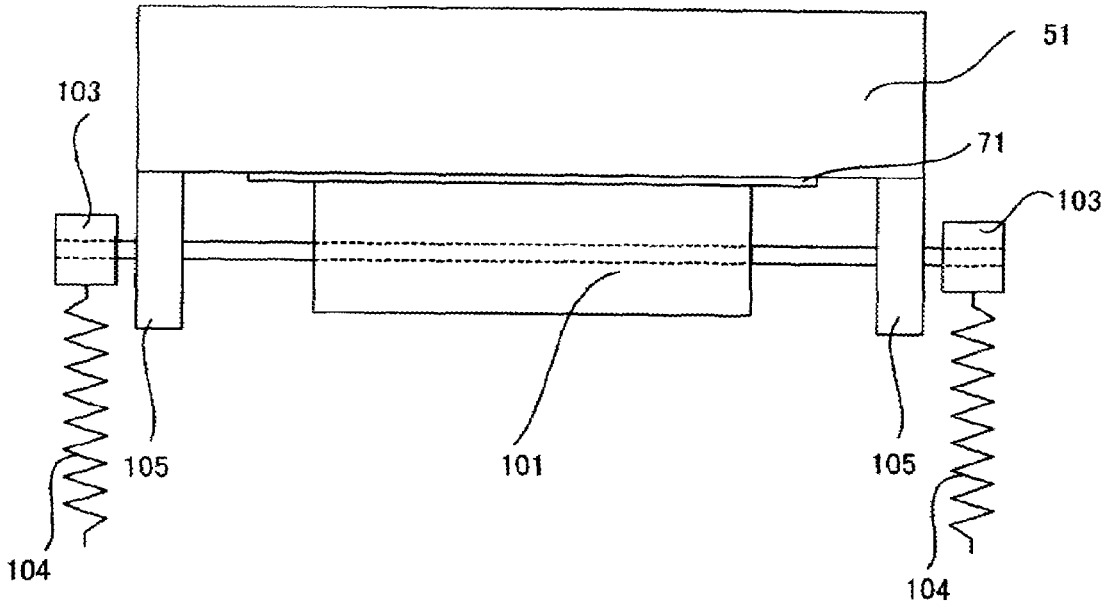
FIG. 5 is a front view of a photosensitive drum and a transfer device according to another illustrative embodiment of the invention.

In addition, to obtain only the effects provided by the rollers 105 made of an elastic material, rollers 105 made of an elastic material may be provided at positions inside the bearings 103 in the axial direction of the transfer roller 101 as shown in FIG. 5, instead of providing the rollers 105 at the positions outside the bearings 103. As above, other material or materials may be used for rollers 105 to provide an elastic effect.

Figure 7A:
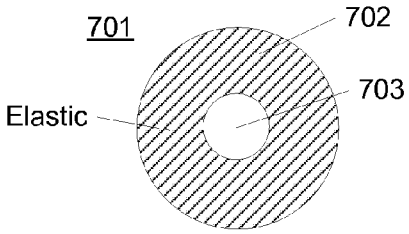
FIG. 7A-7F are illustrative arrangements of regulating rollers exhibiting an elastic effect when urged against one or more components in accordance with aspects of the present invention in accordance with illustrative embodiments of the invention.

FIGS. 7A-7F show illustrative examples of various configurations of rollers that exhibit an elastic effect as described. The FIGS. 7A-7F show rollers or roller configurations 701 that provide an elastic effect during interaction of the FIG. 7A shows roller 702 made of an elastic material surrounding rotating shaft 703.

Figure 7B:
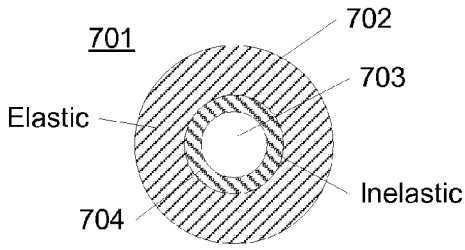
Figure 7C:
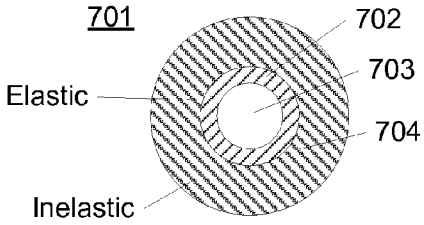

FIGS. 7B and 7C show rollers made of a combination of elastic and inelastic materials. For instance, FIG. 7B shows elastic material 702 surrounding inelastic material 704. At the center of roller 701 is rotating shaft 703. Inelastic material 704 may include metal, ceramic, or other materials that are relatively inelastic compared to elastic material 702. Inelastic material may also include rubber or rubber-based compounds that are less elastic than elastic material 702. FIG. 7C includes inelastic material 704 surrounding elastic material 702 that surrounds rotating shaft 703.

FIGS. 7B and 7C show only one layer of elastic and inelastic materials. It is appreciated that multiple layers may be used where the combination includes either two or more layers of elastic material, two or more layers of the inelastic material, or various combinations of both.

Figure 7D:
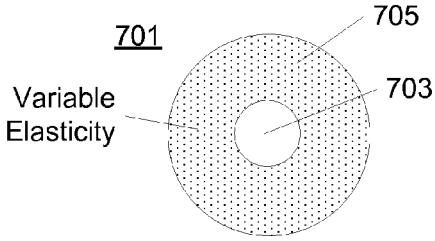

FIG. 7D shows rotating shaft 703 surrounded by material 705 that has a variable level of elasticity. The variation may be achieved by varying material thickness, by different material density across the diameter of roller 701, or other techniques.

Figure 7E:
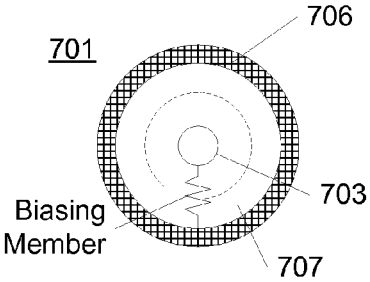
Figure 7F:
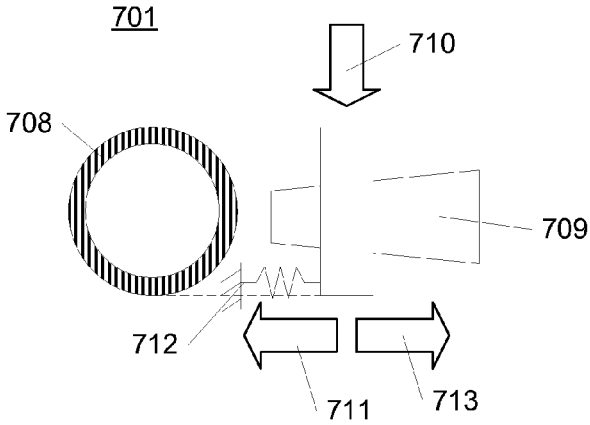

FIGS. 7E and 7F provide a mechanical solution for providing a biasing action using rollers. FIG. 7E shows inelastic material 706 surrounding rotating shaft 703 but biased by biasing member or members 707. Here, the biasing member 707 may be a spring or other elastic member. The biasing member 707 may include metal, plastic, rubber, or any other material that may be made to bias roller 706 against or apart from rotating shaft 703.

FIG. 7F shows another approach to biasing rollers. Here, roller 708 rotates on taped shaft 709. Force from a drum or other assembly is represented by directional arrow pointing down 710. This force is converted into a horizontal movement in direction 711 by the interaction of tapered shaft 709 and roller 708. Biasing member 712 (which may include a spring, bumper, or the like may provide a pushing or pulling force to urge roller 708 in direction 713 thereby providing an upwards movement of roller 708 against the drum or other assembly pushing down in direction 710. Other mechanical solutions may be used as well. Further, combinations of the various approaches of material and/or mechanical solutions of FIGS. 7A-7F may be used as well.

According to one aspect of the illustrative embodiment, a transfer device includes a transfer roller that is rotatably provided facing an image carrying member, an urging device that urges the transfer roller in a direction that the transfer roller presses the image carrying member, and a regulating roller that is provided to a shaft commonly used with the transfer roller and presses the image carrying member to regulate a pressing force of the transfer roller that presses the image carrying member. The regulating roller can be made of an elastic material or other material or materials that alone or in combination exhibit an elastic effect.

In the transfer device as structured above, the material used for the regulating roller can be an elastic material or other material or materials that alone or in combination exhibit an elastic effect for the regulating roller. Therefore, a portion of the regulating roller that presses the image carrying member is shrinkingly deformed when the regulating roller presses the image carrying member. Thus, even if the regulating roller has different diameters due to manufacturing error, the force can equally act on the regulating roller and the transfer roller. Accordingly, the dimension accuracy of the regulating roller can be moderated.

In addition, the regulating roller made of the elastic member is elastically deformed in accordance with an outer shape of a member with which the regulating roller makes contact. That is, the pressing force of the regulating roller that presses the image carrying member does not concentrate on one point at the member. Therefore, in the transfer device of the illustrative embodiment, the member with which the regulating roller makes contact can be prevented from being damaged due to the regulating roller, as compared with a transfer device equipped with a regulating roller made of a material having high stiffness.

More specifically, when a method in which an image carrying member and a transfer roller are contacted with each other and a developing agent image is transferred onto a recording sheet pinched at a nip portion of the image carrying member and the transfer roller, is adopted (for example, a monochrome printing), the regulating roller contacts the image carrying member. Because, however, the regulating roller is made of an elastic material, the image carrying member can be prevented from being damaged due to the regulating roller.

When a method in which a sheet transfer belt is provided and pinched between an image carrying member and a transfer roller and a developing agent image is transferred onto a recording sheet conveyed by the sheet conveyor belt to a nip portion of the image carrying member and the transfer roller (for example, a direct-tandem-method), is adopted, the regulating roller contacts the image carrying member or the sheet conveyor belt in accordance with the width of the sheet conveyor belt.

That is, when the width of the sheet conveyor belt is narrow, the regulating roller contacts the image carrying member. Because, however, the regulating roller can have an elastic effect when biased against one or more components, the image carrying member can be prevented from being damaged due to the regulating roller. When the width of the sheet conveyor belt is wide, the regulating roller contacts the sheet conveyor belt. Because, however, the regulating roller can have an elastic effect when biased against one or more components, the sheet conveyor belt can be prevented from being damaged due to the regulating roller.

When a method in which an intermediate transfer belt is provided and sandwiched between an image carrying member and a transfer roller and a developing agent image is transferred onto the intermediate transfer belt (for example, a well-known intermediate transfer method), the regulating roller contacts the image carrying member or the intermediate transfer belt in accordance with a width of the intermediate transfer belt.

That is, when the width of the intermediate transfer belt is narrow, the regulating roller contacts the image carrying member. Because, however, the regulating roller can have an elastic effect when biased against one or more components, the image carrying member can be prevented from being damaged due to the regulating roller. When the width of the intermediate transfer belt is wide, the regulating roller contacts the intermediate transfer belt. Because, however, the regulating roller can have an elastic effect when biased against one or more components, the intermediate transfer belt can be prevented from being damaged due to the regulating roller.

According to another aspect of the illustrative embodiment, in the transfer device, the material used for the regulating roller may have hardness that is higher than a portion of the transfer roller that presses the image carrying member. In addition, the regulating roller may have a diameter that is larger than a diameter of the transfer roller.

Because, for example, when the regulating roller and the transfer roller have the same diameter and hardness, the regulating roller needs to have a certain amount of a thickness with respect to a length (in an axial direction) of the transfer roller, in order that the regulating roller regulates the pressing force of the transfer roller that presses the image carrying member (hereinafter, referred to as a roller pressing force). In other words, the thickness of the regulating roller can be reduced as the regulating roller has a higher hardness with respect to the transfer roller or as the regulating roller has a larger diameter.

According to another aspect of the illustrative embodiment, in the transfer device, the material used for the regulating roller may be an insulation material.

By doing so, a transfer current applied to the transfer device can be prevented from being fed to the image carrying member via the regulating roller. That is, the transfer current can be surely controlled.

According to another aspect of the illustrative embodiment, in the transfer device, the transfer roller may include a rotating shaft that protrudes from both ends of the transfer roller in directions away from the transfer roller with respect to an axial direction of the transfer roller. The urging device may urge the rotating shaft to allow the transfer roller to press the image carrying member. The regulating roller may be provided to the rotating shaft so as to be opposite to the transfer roller while a portion of the rotating shaft that is urged by the urging device is sandwiched therebetween.

In the transfer device structured as described above, when the regulating roller urged by the urging device presses the image carrying member, a repulsive force is generated therebetween by the pressing and is applied to a portion of the rotating shaft where the regulating roller is provided.

In other words, the force that is reverse to the direction that the urging device urges the rotating shaft is applied to the portion that is far from the transfer roller than the portion where the urging device urges the rotating shaft.

Accordingly, the rotating shaft can be prevented from warping, due to the urging force of the urging device, in a direction that end portions of the rotating shaft move closer to the image carrying member.

According to another aspect of the illustrative embodiment, a transfer device may include a transfer roller that includes a rotating shaft, which faces an image carrying member, at its center, and is capable of rotating about the rotating shaft, an urging device that urges the rotating shaft in a direction that the transfer roller presses the image carrying member, and a regulating roller that is provided to the rotating shaft so as to be opposite to the transfer roller while a portion of the rotating shaft that is urged by the urging device is sandwiched therebetween. The regulating roller may press the image carrying member to regulate a pressing force of the transfer roller that presses the image carrying member.

In the transfer device structured as described above, when the regulating roller presses the image carrying member, a repulsive force is generated therebetween by the pressing and is applied to a portion of the rotating shaft where the regulating roller is provided. In other words, the force that is reverse to the direction that the urging device urges the rotating shaft is applied to the portion that is far from the transfer roller than the portion where the urging device urges the rotating shaft.

Thus, the rotating shaft can be prevented from warping, due to the urging force of the urging device, in a direction that end portions of the rotating shaft move closer to the image carrying member.

According to another aspect of the illustrative embodiment, a transfer device may include a transfer roller that includes a rotating shaft, which faces an image carrying member, at its center, and is capable of rotating about the rotating shaft, an urging device that urges the rotating shaft in a direction that the transfer roller presses the image carrying member, and a pressing device that presses the rotating shaft in a direction reverse to the direction that the urging device urges the rotating shaft, when the urging device urges the rotating shaft.

In the transfer device structured as described above, the roller pressing force is regulated by the pressing device. As a result, the regulating roller is not necessary to be provided, so that the member with which the regulating roller makes contact can be prevented from being damaged.

According to another aspect of the illustrative embodiment, in the transfer device, the pressing device may press the rotating shaft at a position opposite to the transfer roller while a portion of the rotating shaft that is urged by the urging device is sandwiched therebetween.

In the transfer device structured as described above, the force that is reverse to the direction that the urging device urges the rotating shaft is applied to the portion that is far from the transfer roller than the portion where the urging device urges the rotating shaft.

Accordingly, the rotating shaft can be prevented from warping, due to the urging force of the urging device, in a direction that end portions of the rotating shaft move closer to the image carrying member.

According to another aspect of the illustrative embodiment, an image forming apparatus may include an image carrying member, a developing device that supplies a developing agent to the image carrying member, a transfer roller that is rotatably provided facing the image carrying member, an urging device that urges the transfer roller in a direction that the transfer roller presses the image carrying member, and a regulating roller that is provided to a shaft commonly used with the transfer roller and presses the image carrying member to regulate a pressing force of the transfer roller that presses the image carrying member. The regulating roller can have an elastic effect when biased against one or more components.

According to the image forming apparatus structured as described above, effects that are the same as the effects obtained by the transfer device according to one aspect of the illustrative embodiment of the invention, can be obtained.

According to another aspect of the illustrative embodiment, an image forming apparatus may include a plurality of image carrying members, a plurality of developing devices, each of which supplies a developing agent to each of the respective plurality of image carrying members, a plurality of transfer devices, each of which includes a transfer roller that is rotatably provided facing the corresponding one of the plurality of image carrying members, and an urging device that urges the transfer roller in a direction that the transfer roller presses the corresponding one of the plurality of image carrying members, and a regulating roller that is provided to a shaft commonly used with the transfer roller and presses the corresponding one of the plurality of image carrying members to regulate a pressing force of the transfer roller that presses t the corresponding one of the plurality of image carrying members. The regulating rollers can have an elastic effect when biased against one or more components.

According to the image forming apparatus structured as described above, effects that are the same as the effects obtained by the transfer device according to one aspect of the illustrative embodiment of the invention can be obtained.

What is claimed is:

1. A transfer device comprising:

a transfer roller that is rotatably provided facing an image carrying member;

an urging device that urges the transfer roller in a direction that the transfer roller presses the image carrying member; and a regulating roller that is provided to a shaft commonly used with the transfer roller and presses the image carrying member to regulate a pressing force of the transfer roller that presses the image carrying member, wherein the regulating roller is made of an elastic material, wherein the material used for the regulating roller has hardness that is higher than a portion of the transfer roller that presses the image carrying member.

2. The transfer device according to claim 1, wherein the regulating roller has a diameter that is larger than a diameter of the transfer roller.

3. The transfer device according to claim 1, wherein the material used for the regulating roller is an insulation material.

4. A transfer device comprising:

a transfer roller that is rotatably provided facing an image carrying member;

an urging device that urges the transfer roller in a direction that the transfer roller presses the image carrying member; and a regulating roller that is provided to a shaft commonly used with the transfer roller and presses the image carrying member to regulate a pressing force of the transfer roller that presses the image carrying member, wherein the regulating roller is made of an elastic material, wherein the transfer roller includes a rotating shaft that protrudes from both ends of the transfer roller in directions away from the transfer roller with respect to an axial direction of the transfer roller, wherein the urging device urges the rotating shaft to allow the transfer roller to press the image carrying member, and wherein the regulating roller is provided to the rotating shaft so as to be opposite to the transfer roller while a portion of the rotating shaft that is urged by the urging device is sandwiched therebetween.

5. A transfer device comprising:

a transfer roller that includes a rotating shaft, which faces an image carrying member, at its center, and is capable of rotating about the rotating shaft;

an urging device that urges the rotating shaft in a direction that the transfer roller presses the image carrying member; and a regulating roller that is provided to the rotating shaft so as to be opposite to the transfer roller while a portion of the rotating shaft that is urged by the urging device is sandwiched therebetween, the regulating roller pressing the image carrying member to regulate a pressing force of the transfer roller that presses the image carrying member.

6. A transfer device comprising:

a transfer roller that includes a rotating shaft, which faces an image carrying member, at its center, and is capable of rotating about the rotating shaft;

an urging device that urges the rotating shaft in a direction that the transfer roller presses the image carrying member; and a pressing device that presses the rotating shaft in a direction reverse to the direction that the urging device urges the rotating shaft, when the urging device urges the rotating shaft.

7. The transfer device according to claim 6, wherein the pressing device presses the rotating shaft at a position opposite to the transfer roller while a portion of the rotating shaft that is urged by the urging device is sandwiched therebetween.

8. An image forming apparatus comprising:

an image carrying member;

a developing device that supplies a developing agent to the image carrying member;

a transfer roller that is rotatably provided facing the image carrying member;

an urging device that urges the transfer roller in a direction that the transfer roller presses the image carrying member; and a regulating roller that is provided to a shaft commonly used with the transfer roller and presses the image carrying member to regulate a pressing force of the transfer roller that presses the image carrying member, wherein the regulating roller is made of an elastic material, wherein the material used for the regulating roller has hardness that is higher than a portion of the transfer roller that pressed the image carrying member.

9. An image forming apparatus comprising:

a plurality of image carrying members;

a plurality of developing devices, each of which supplies a developing agent to each of the respective plurality of image carrying members;

a plurality of transfer devices, each of which includes:

a transfer roller that is rotatably provided facing the corresponding one of the plurality of image carrying members; and an urging device that urges the transfer roller in a direction that the transfer roller presses the corresponding one of the plurality of image carrying members; and a regulating roller that is provided to a shaft commonly used with the transfer roller and presses the corresponding one of the plurality of image carrying members to regulate a pressing force of the transfer roller that presses the corresponding one of the plurality of image carrying members, wherein the regulating rollers are made of an elastic material, wherein the material used for the regulating roller has hardness that is higher than a portion of the transfer roller that pressed the image carrying member.

10. A transfer device comprising:

a transfer roller that is rotatably provided facing an image carrying member;

an urging device that urges the transfer roller in a direction that the transfer roller presses the image carrying member; and a regulating roller that is provided to a shaft commonly used with the transfer roller and presses the image carrying member to regulate a pressing force of the transfer roller that presses the image carrying member, wherein the regulating roller is elastically biased when pressing the transfer roller against the image carrying member, wherein the regulating roller includes at least one biasing member that elastically biases an outer surface of the regulating roller.

11. The transfer device according to claim 10, wherein the material used for the regulating roller includes elastic and inelastic materials.

12. The transfer device according to claim 10 wherein the material used for the regulating roller is an insulation material.

13. The transfer device according to claim 10, wherein the regulating roller includes a material having variable elasticity.

14. A transfer device comprising:

a transfer roller that is rotatably provided facing an image carrying member;

an urging device that urges the transfer roller in a direction that the transfer roller presses the image carrying member; and a regulating roller that is provided to a shaft commonly used with the transfer roller and presses the image carrying member to regulate a pressing force of the transfer roller that presses the image carrying member, wherein the regulating roller is elastically biased when pressing the transfer roller against the image carrying member, wherein the material used for the regulating roller is a semiconducting material.

15. A transfer device comprising:

a transfer roller that is rotatably provided facing an image carrying member;

an urging device that urges the transfer roller in a direction that the transfer roller presses the image carrying member; and a regulating roller that is provided to a shaft commonly used with the transfer roller and presses the image carrying member to regulating a pressing force of the transfer roller that presses the image carrying member, wherein the regulating roller is elastically biased when pressing the transfer roller against the image carrying member, wherein the material used for the regulating roller is a conducting material.

* * * * *